US005980159A

United States Patent [19]

Kazim

[11] Patent Number: 5,980,159

[45] Date of Patent: Nov. 9, 1999

[54] MARINE STABILISING SYSTEM AND METHOD

[76] Inventor: Jenan Kazim, 26 London Road, St Albans, Herts, United Kingdom

[21] Appl. No.: 08/849,318

[22] PCT Filed: Dec. 11, 1995

[86] PCT No.: PCT/GB95/02883

§ 371 Date: Jun. 9, 1997

§ 102(e) Date: Jun. 9, 1997

[87] PCT Pub. No.: WO96/17767

PCT Pub. Date: Jun. 13, 1996

[30] Foreign Application Priority Data

Dec. 9, 1994 [GB] United Kingdom ..... 9424930

[51] Int. Cl.[6] ..... B63B 35/44

[52] U.S. Cl. ..... 405/200; 405/196

[58] Field of Search ..... 405/195.1, 196, 405/200, 203, 204, 205, 207, 224

[56] References Cited

U.S. PATENT DOCUMENTS

| | | | |
|---|---|---|---|
| 2,960,833 | 11/1960 | Hayward | 405/200 |
| 3,294,051 | 12/1966 | Khelstovsky . | |
| 3,390,654 | 7/1968 | Bromell et al. . | |
| 3,738,113 | 6/1973 | Madary et al. | 405/205 |
| 4,031,581 | 6/1977 | Baugh | 405/205 |
| 4,039,177 | 8/1977 | Person et al. . | |
| 4,060,995 | 12/1977 | Lacroix et al. | 405/207 |
| 4,176,614 | 12/1979 | Goss et al. | 405/200 |
| 4,241,685 | 12/1980 | Mougin | 405/205 |
| 4,428,702 | 1/1984 | Abbott et al. . | |
| 4,898,288 | 2/1990 | Erdbrink . | |
| 5,363,788 | 11/1994 | Delrieu . | |

FOREIGN PATENT DOCUMENTS 2 150 516 7/1985 United Kingdom .

*Primary Examiner*—David J. Bagnell
*Assistant Examiner*—Frederick L Lagman
*Attorney, Agent, or Firm*—Knobbe, Martens, Olson & Bear, LLP

[57] ABSTRACT

A buoyancy assembly suitable for supporting, either alone or in combination, a load deck or other marine body, said assembly comprising a first portion adapted to be connected to the marine body and a second portion (1) adapted, in combination with the first portion, to contain a variable volume (4) of compressed gas, characterised in that the first portion is moveable, in use, relative to the second portion (1), said movement tending to maintain hydrostatic equilibrium such that when disturbed from its position of equilibrium the marine body will develop a restoring force, upwards or downwards.

19 Claims, 11 Drawing Sheets

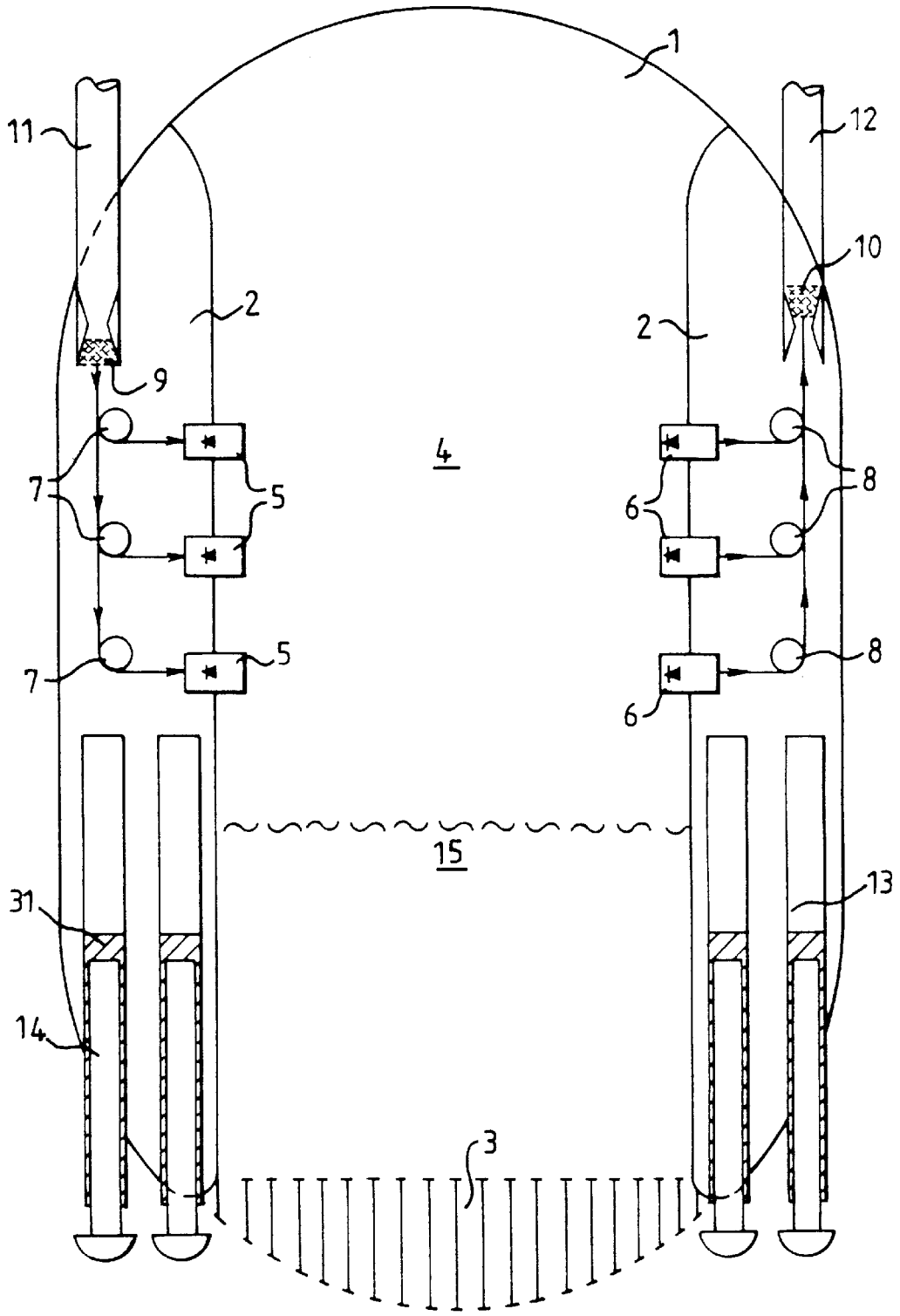
FIG. 1.0

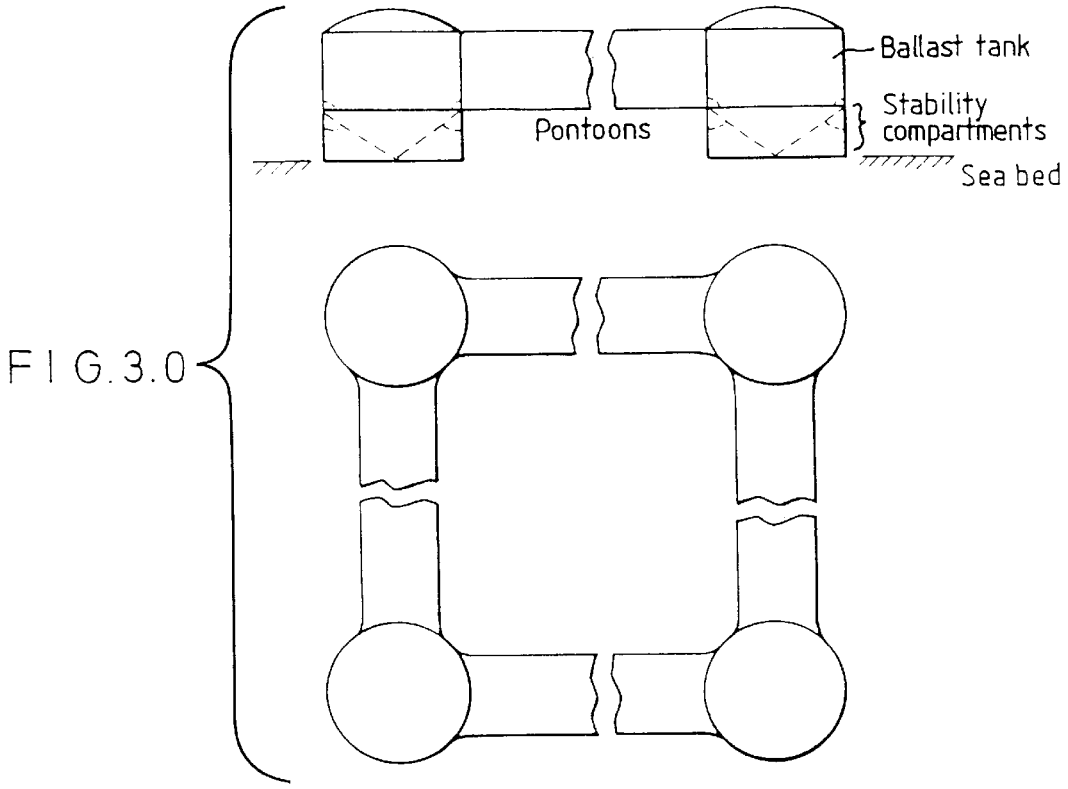
FIG.3.0
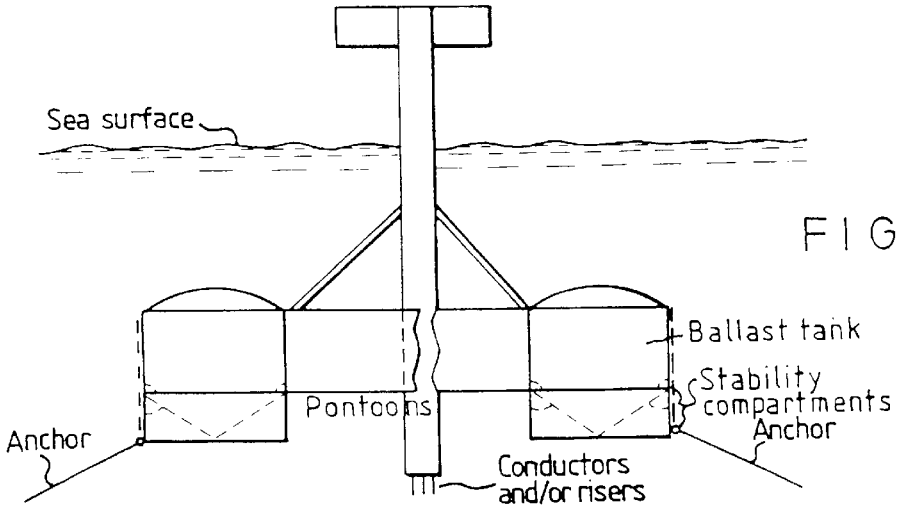
FIG.4.0

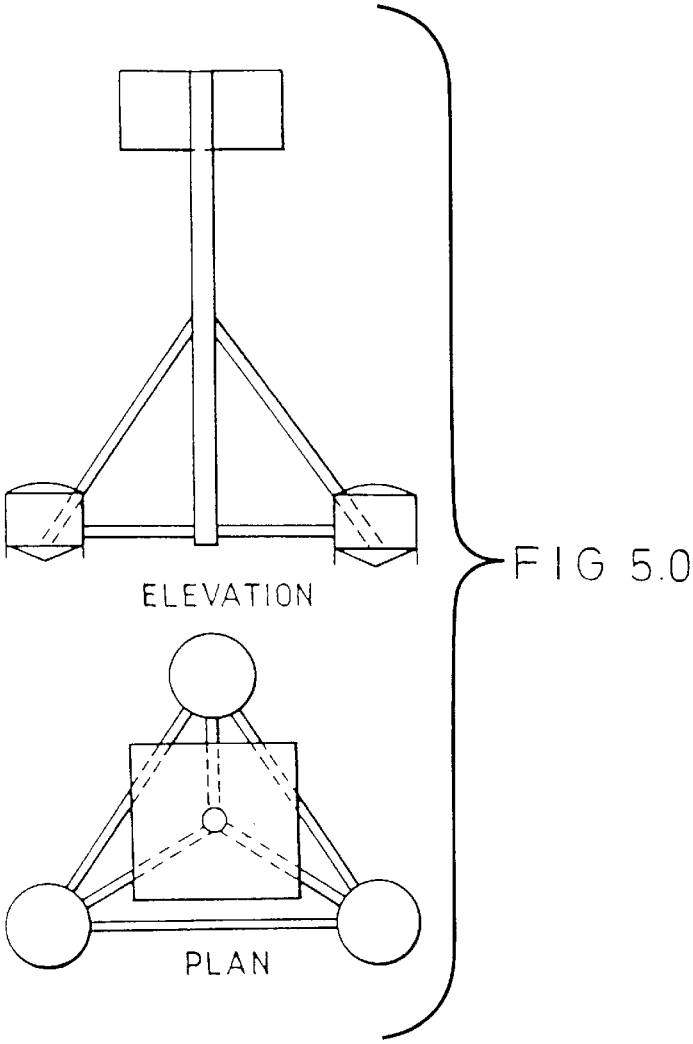
FIG 5.0
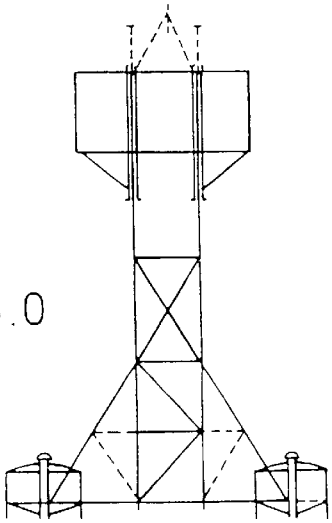
FIG.6.0
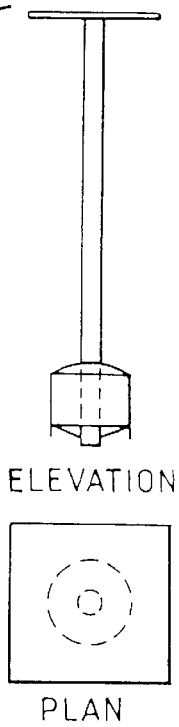
FIG 7.0

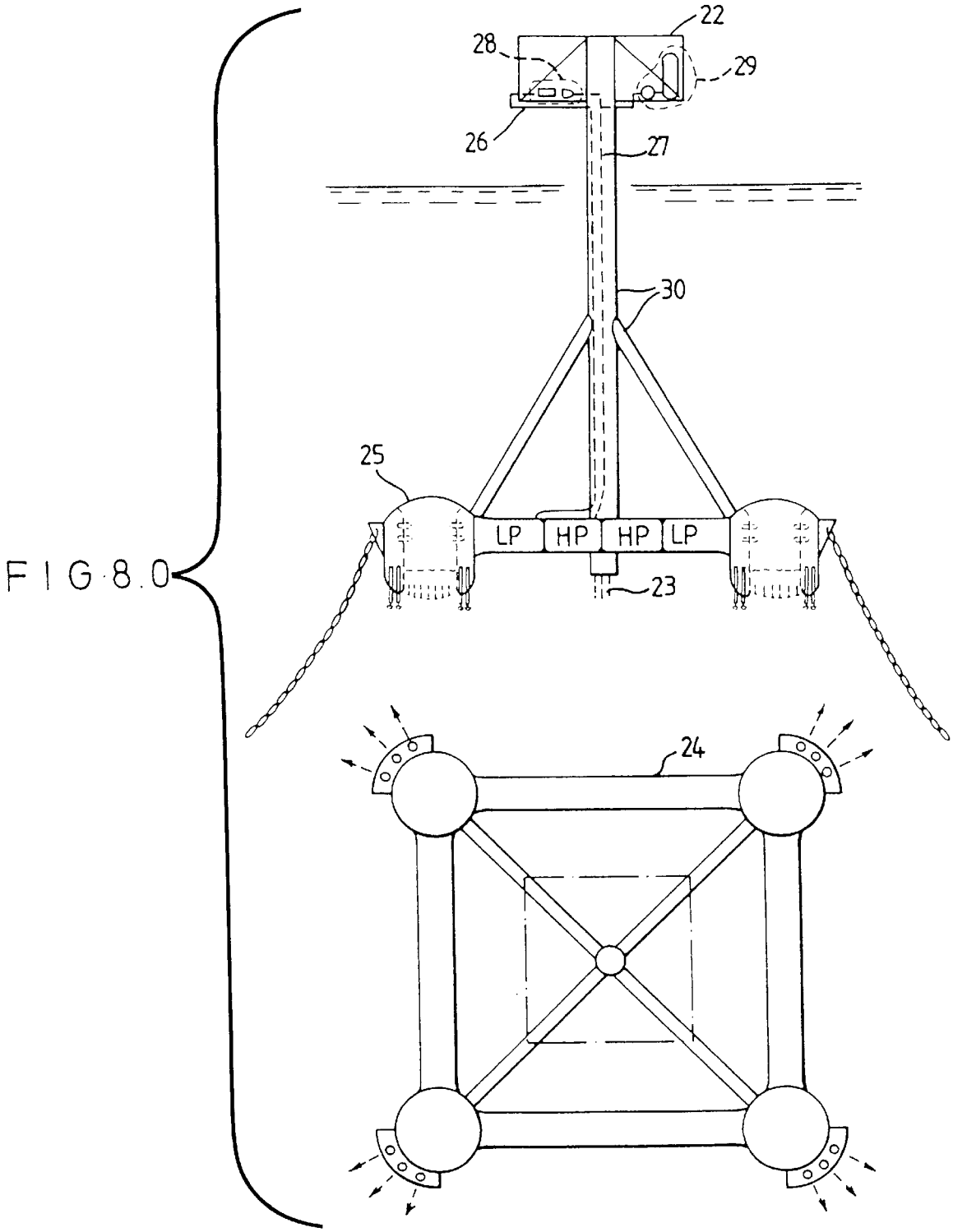
FIG.8.0

MARINE STABILISING SYSTEM AND METHOD

FIELD OF THE INVENTION

The invention relates to a buoyancy assembly suitable for use with marine bodies. It is particularly, but not exclusively applicable to oil exploration platforms and the like.

BACKGROUND TO THE INVENTION

There have been a number of ways that the stability have been provided for in marine structures.

Floating facilities either ship-shape or column stabilised, achieve stability through changing buoyancy by part of their body coming in or out of water. It is because of this requirement that a large part of their body providing buoyancy and stability is exposed to maximum environmental loading.

Submarines achieve static stability by ballast control using external power of pumps to pump water in or out of the vessel as required.

Non-floating structures are stabilised either by piling to the sea bed as foundation or by being attached to large weights known as gravity foundations.

There are also tethered structures which have tethers stabilised by gravity or piling, acting against the buoyancy of a floating vessel and keeping the tethers always in tension. The stability of the vessel is either provided by the tension in the tethers or a combination of the tension as well as the buoyancy changes due to the vessel coming in or out of the water.

Providing piled stabilised foundation is expensive, requiring specialised crane vessels, pile driving hammers and the expense of the piles. Gravity stabilised foundation require large, usually concrete, structures and expensive ballast systems. These structures need to be either externally stabilised for transportation and installation offshore or their stability element would need to be water surface piercing attracting environmental loads. Structures sitting on the sea bed fully submerged would need crane vessels to lower them down or raise them up and still require to be stabilised by a foundation.

Floating facilities which are utilised as offshore platforms for mineral production require to keep station whilst being connected to the source of the minerals. However, as they need to be surface piercing for their stability, they are at times subjected to severe environmental loads. In order to minimise their motions and for station keeping a number of facilities have been developed. These include:

Dynamic positioning systems which use trusters to resist the wave forces. These are also used to turn a ship around to face the waves. Turrets are required to allow the ships to turn around a moonpool housing pipes connected to the source of the minerals.

Tensioners can be used but these have the expense of the foundation as well as the tensioners.

In summary, the known technology is expensive to install and expensive to operate on a day-to-day basis. No one technology can provide buoyancy and stability when partially and fully submerged as well as providing foundation stability to a structure sitting on the sea bed. No one existing marine stabilising system has the facility to alter its dynamic characteristics to suit changes in the environmental loads. It is the object of the present invention to overcome some or all of these disadvantages.

This invention relates to marine bodies that can provide hydrostatic stability even when fully submerged, have the facility for altering its dynamic characteristics and provide sea bed foundations that minimise or eliminate the vertical loads acting on the sea bed.

SUMMARY OF THE INVENTION

According to the present invention, in its broadest sense, there is provided a buoyancy assembly suitable for supporting, either alone or in combination, a load deck or other marine body said assembly comprising:

(i) a first portion adapted to be connected to the marine body, said first portion defining a chamber adapted to contain a variable volume of compressed gas, the first portion being open to the water at or near its lowermost-in-use region to allow ingress of water to form a water pool inside the first portion, the surface of the water pool being in contact with the compressed gas above it;

(ii) a second portion adapted to be moveable in relation to the first portion, said second portion also defining a chamber adapted to contain a variable volume of compressed gas:

wherein the assembly also comprises a connecting means adapted to enable gas to flow between the first and second portions and vice-versa, the assembly being adapted such that when the assembly is displaced from equilibrium, either up or down, the free surface of the water pool in the first portion will rise or fall with respect to its equilibrium position and the resulting change in gas pressure in the gas above the water pool will cause the first and second portions to move with respect to each other such that a restoring force, upwards or downwards, is generated tending to restore equilibrium. This provides the ability to alter the buoyancy characteristics in response to a displacement of the equilibrium even when the buoyancy unit is completely submersed.

Preferably the second portion is open to the water at or near its lowermost-in-use region. This provides both an active and passive system.

Preferably the first portion comprises a casino which, in its normal orientation in use, incorporates at least one dependent skirt, the skirt(s) being aligned with the longitudinal axis of the first portion, said at least ore skirt acting to constrain the second portion to move substantially parallel to the longitudinal axis of the casing.

Preferably the first portion fur her incorporates a dependent shroud extending substantially around the perimeter of the casing.

Preferably the shroud incorporates at least one opening to allow access and egress of water.

In a particularly preferred embodiment the second portion comprises an annular cylinder, at least a portion of the cylinder being open to the water at its lowermost in use end, the water level in the first and second portions being substantially the same at hydrostatic equilibrium.

Preferably the annular cylinder is compartmentalised, the lowermost in use end of at least one compartment being closed to the water, the closed compartment being adapted to contain compressed air or ballast or a mixture of both.

The invention extends to a buoyancy assembly as described above wherein the assembly further comprises an active ballasting system comprising:

(i) low pressure gas reservoir;

(ii) high pressure gas reservoir;

(iii) compressor;

(iv) control means;

the system being adapted to supplement the restoring force exerted by the movement of the first portion relative to the second by varying the gas pressure as required.

Preferably the lowermost-in-use region of the assembly incorporates one or more skirts adapted to penetrate the sea bed to provide lateral stability hen the unit rests on the sea bed.

The invention extends to a marine body incorporating such buoyancy assemblies and a method of stabilising a marine body comprising the steps of:

(a) providing one or more buoyancy assemblies as described above;

(b) attaching the or each buoyancy assembly to a marine body;

(c) providing control means adapted to control the operation of the or each buoyancy assembly such that the marine body is stabilised at the desired point of hydrostatic equilibrium or provided with the desired foundation stability.

BRIEF DESCRIPTION OF THE DRAWINGS

Embodiments of the present invention will now be more particularly described by way of example only and with reference to the accompanying diagrammatic drawings in which:

FIG. 1 shows a cross-sectional elevation of a buoyancy assembly according to a first embodiment;

FIGS. 2(*a*) and (*b*) show cross-sections of vent bowel assemblies;

FIG. 3 shows plan and elevational views of a four compartment floating or submersible pontoon;

FIG. 4 shows an elevational view of buoyancy assemblies in use on a deep sea development;

FIGS. 5, 6 and 7 show plan and elevational views of various braced monopod designs incorporating buoyancy assemblies according to the invention;

FIG. 8 shows in more detail the deep sea development illustrated in FIG. 4;

DESCRIPTION OF THE PREFERRED EMBODIMENTS

Figure 20:
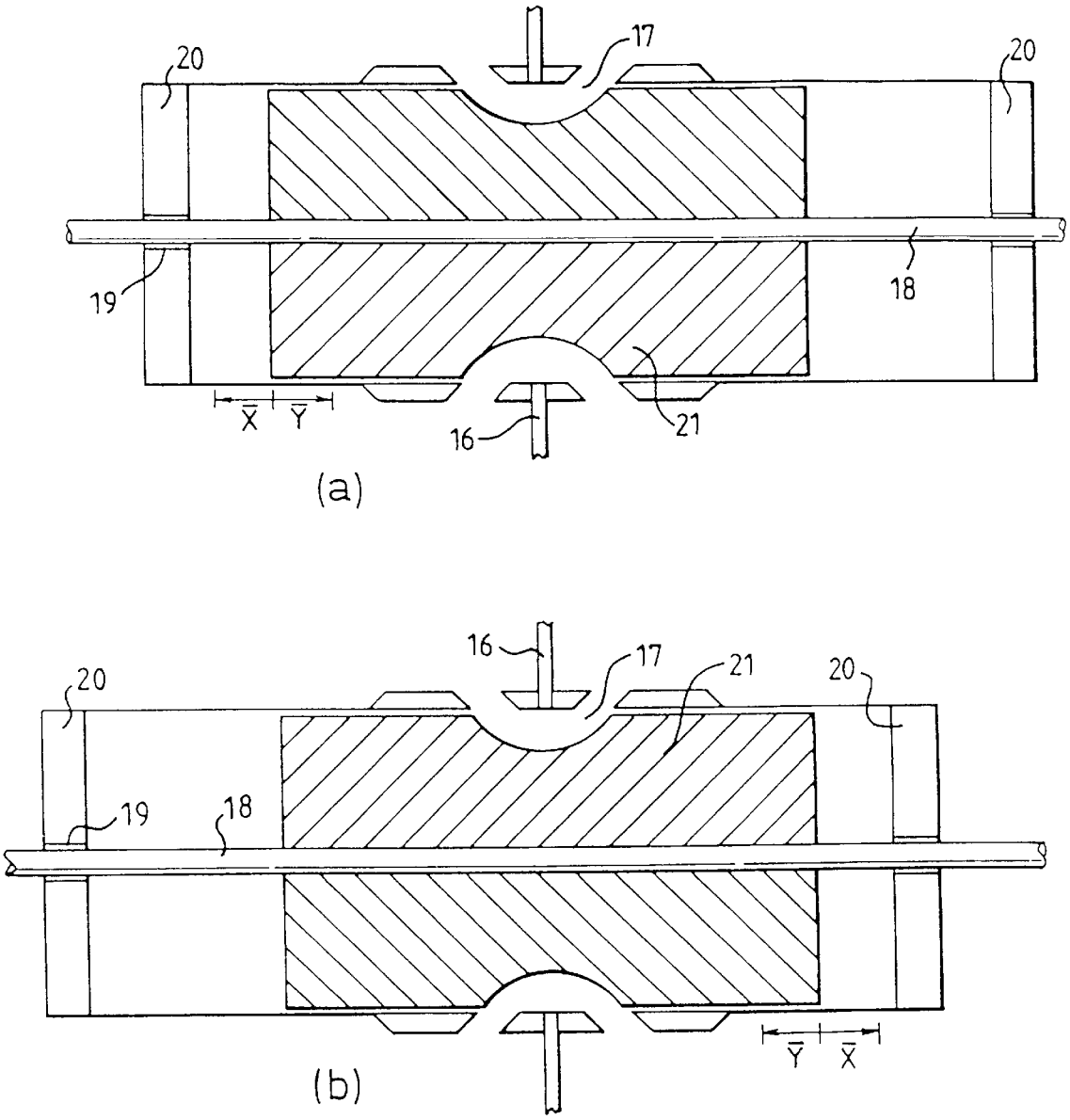
Figure 9:
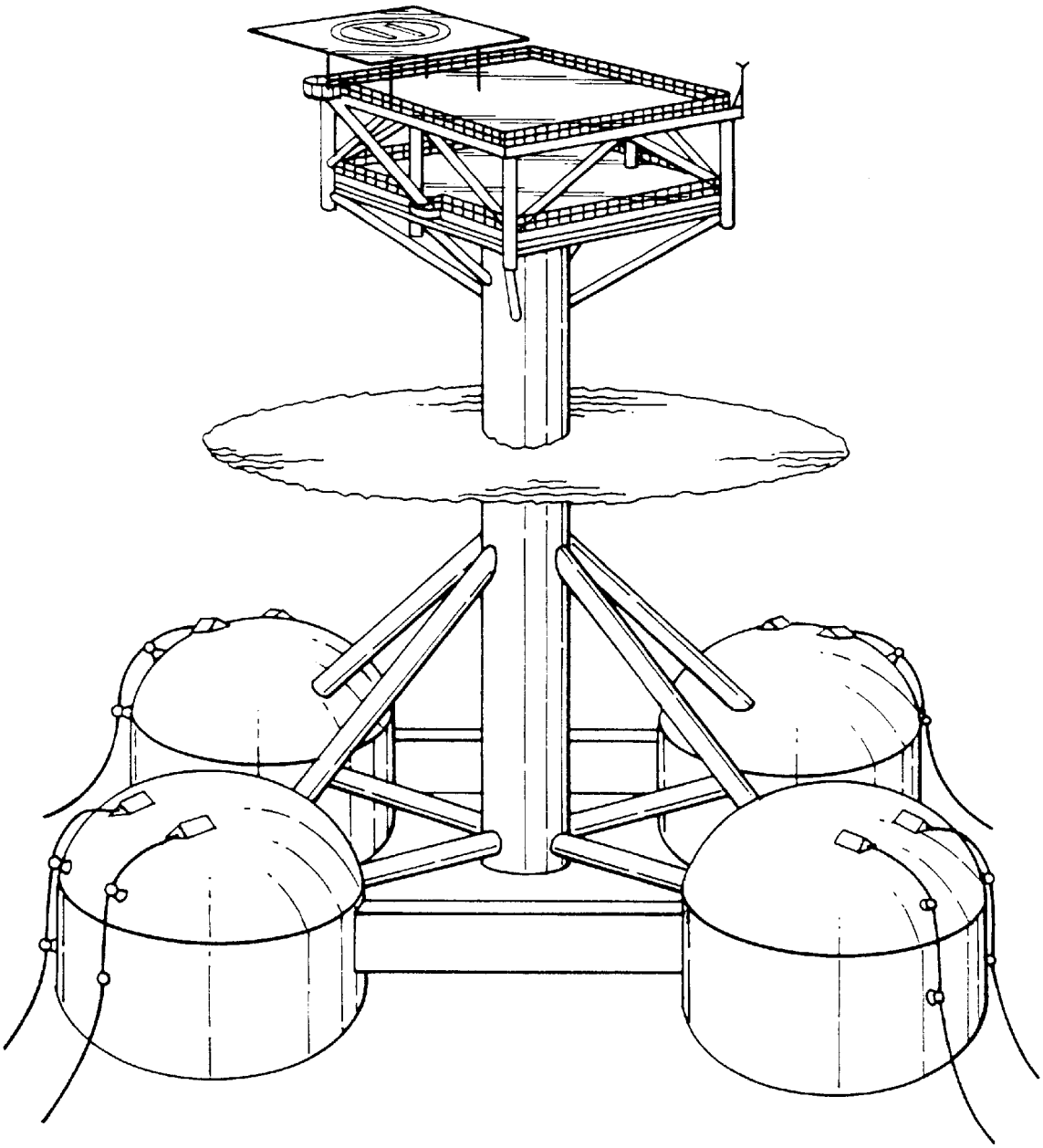
FIG. 9 illustrates various perspective views of a platform stabilised by buoyancy assemblies according to the present invention.

The present invention is a marine stabilising system which separates the buoyancy generating element of the structure from the element supporting the cargo and its self weight. It can provide buoyancy and stability when partially submerged, fully submerged and foundation stability to any structure requiring support from the bed.

In a state of equilibrium, a neutral buoyant marine body will be at rest when its centre of gravity and centre buoyancy lie on the same vertical line. This is true whether the body is fully or partly submerged. When the body is disturbed it would require a righting force to restore its stability. If its centre of buoyancy is lower then the centre of gravity, which is the case for most practical marine applications, the stability is provided by the second moment of the waterplane area, which is the area enclosed by the body piercing the sea surface. In this case, when the body is forced downwards through the sea surface, it would develop a restoring force upwards and when forced upwards it would develop a restoring force downwards. Therefore when the body is fully submerged and there is no waterplane area, the hydrostatic stability is lost. The consequence of this requirement is that a large part of a marine body has to remain outside the water, being exposed to the environmental loading.

According to the present invention, when disturbed the marine body will develop a restoring force, upwards or downwards when disturbed from its position of neutral buoyancy even when fully submerged. Therefore there is no need to have part of the structure piercing the water in order to provide a restoring force.

The basic embodiment of the invention is shown in FIG. 1.0, but the shape of the body can be altered to suit specific application. However, the basic principal would apply to all marine systems which require hydrostatic stability when fully submerged. The characteristics of the invention are explained by referring to FIG. 1.0 which shows the five basic components.

Central Tank

Peripheral Tanks

Air Vent System

Compressed air supply System

Plungers System

The central tanks marked 3, 4 and 15 are partly filled with compressed air shown as (4) which would be at a pressure equal to the free water surface pressure in the tank shown as 15. This pressure will depend on the water depth to the free water surface as the tank would be open to the sea at the bottom, shown as 3 which may have a grid to act as a filter or to smooth the flow in and out of the tank.

The peripheral tanks marked 2 may consist of a number of tanks containing compressed air. At a given depth in an equilibrium condition the air pressure in the peripheral tanks is the same as the air pressure in the central tank. Valves 5 an 6 between the central and peripheral tanks are open for equilibrium conditions and for small disturbances allowing free air flow between the tanks. Valves marked 5 are used for venting and 6 used for feeding compressed air into the central tank.

The Air Vent System marked as 5, 7, 9 and 11. The valve 5 is shown in detail in FIG. 2.0(*a*). This valve consists of a plunger marked 21 shown in its equilibrium position and subjected to the air pressures from the central and the peripheral tanks which are separated by the wall 16. The air is free to move between the tanks through the opening marked 17. The ends of the valve marked 20 are open and fins support the bearings. The plunger is allowed to move a distance X before it comes to rest whilst closing the space marked 17 and allowed to move a distance Y the other way which again closes the space marked 17 and also starts actuating the venting system.

The pulleys, rack and pinion of some other mechanical device marked 7 may be used to transmit the movements of the plunger 21 as defined above. The movements greater than distance Y will facilitate the opening of the valve 9 venting the air into the vent pipe 11 which is maintained at a lower pressure than the pressure in the tanks. The pressure difference would be a function of the reference pressure in the tanks and flow rates required for the performance of the vessel.

The compressed air supply system marked as 6, 8, 10 and 12. The valve 6 is shown in detail in FIG. 2.0(*b*). This valve consists of a plunger marked 21 shown in its equilibrium position and subjected to the air pressures from the central and the peripheral tanks which are separated by the wall 16. The air is free to move between the tanks through the opening marked 17. The plunger is supported by a shaft marked 18 which is free to slide in a bearing system marked 19. The ends of the valve marked 20 are open and fins supported the bearings. The Plunger is allowed to move a distance X before it comes to rest whilst closing the space marked 17 and allowed to move a distance Y the other way again closes the space 17 and also starts actuating the compressed air supply system.

The pulleys, rack and pinion or some other mechanical device marked 6 may be used to transmit the movements of the plunger 21 as defined above. The movements greater than distance Y will facilitate the opening of the valve 10 allowing the compressed air into the peripheral tanks from the high pressure pipe 12 which is connected to and maintained at a higher pressure than the pressure in the tanks. The pressure difference would be a function of the reference pressure in the tanks and flow rates required for the performance of the vessel.

It is also possible to utilise readily available detectors actuators and valves to design a system which detects the changes in air pressure relative to a reference pressure and actuates the valves. The reference pressure may typically be the water pressure at the design water depth. When the system detects a reducing compressed air pressure, the venting valves are actuated venting air until the body comes to rest. When the system detects an increasing compressed air pressure the feed valve is actuated supplying high pressure air until the body comes to rest.

The plunger system consists of a plunger 13 which is free to move within a pipe marked 14 attached to the tank. The annulus between the plunger and the pipe is lubricated with some lubricant marked 31 which would also act as a seal. This lubricant may be oil based such as grease. The plunger is at neutral buoyancy when the whole system is at a state of equilibrium. The bottom of the plunger is large enough to provide a sufficient drag area and added mass volume to force the plunger to lag relative to the tank motions. The plungers would provide a syringe like suction whilst the tank moves upwards and compression whilst it moves downwards. The suction would reduce the pressure allowing the water level in the central tank to rise, thereby reducing the buoyancy. The compression would do the reverse. This facility would act as a stabilising force and damping against an externally applied temporary load such as the waves and currents.

The fundamental principals of the invention are explained below:

When the initial equilibrium of the system is disturbed, moving up or down, the free surface of the water pool will rise or drop with respect to its original position. This will change the volume of the free air V, by dV causing a change in the pressures. This change is dependent on the original volume of the free air. The stability can be achieved in one of the two ways outline below or the combination of the two.

1. Utilising the actuator and valve systems to detect changes from a reference pressure which would be set to the hydrostatic water pressure for the design depth. When the body moves up, the compressed air pressure will reduce actuating the venting valve/pipe system. This would vent the air causing reduction in buoyancy until the body comes to rest. Similarly, when the body moves down, the compressed air pressure will increase actuating the air feed valve/pipe increasing the buoyancy until the body comes to rest. The venting and feed system can be controlled actively providing the required response characteristics.

A particular actuator/valve system are shown in FIG. 1.0 and FIG. 2.0 for both the venting and feed facilities. These systems are explained above paragraphs titled "The Air Vent System" and "The Compressed Air Supply System". The sensitivity of the valves can be adjusted to provide the required response characteristics. This can be further enhanced by using more than one type of valve of different sensitivities and operating flow characteristics or a single valve system that can be actively adjusted for the required response characteristics.

2. This system relies on vertical plungers in the peripheral tanks as shown in FIG. 1.0 marked as 13 and 14. They provide stability against temporary loads such as the waves. In a state of equilibrium at the design depth the plungers weight is equal to their buoyancy. When the tanks are disturbed, the air pressure inside the tanks will change disturbing the equilibrium of the plungers. However, the bottom of the plungers are enlarged sufficiently so that the drag and inertial hydrodynamic forces generated by them would slow the plungers relative to the tank motions. These forces can be calculated using the Morison's equation for waves and currents. Whilst the tanks move upwards the plungers would lag behind, partly due to dynamic inertia effects and partly due to hydrodynamic forces developed due to their motions. This causes a suction in the peripheral tanks which in turn would cause the water level in the central tank to rise, reducing the buoyancy. Similarly, when the tanks move down, the plungers are pushed up, further compressing the air and forcing the water level in the central tank to be lowered, thereby increasing the buoyancy. This system would facilitate a decreasing buoyancy for upward and increasing buoyancy for downwards motions, thus providing hydrostatic stability even when fully submerged.

Throughout this document the term compressed air means compressed gas or gases other than air that can be used to achieve the required compressibility characteristics.

A further advantage of this invention is its versatility in application. This is because it would facilitate hydrostatic stability even when fully submerged. When on the sea bed, the tanks can be ballasted with heavier than water ballast to provide gravity foundation. Some of the examples of the applications in the offshore oil and gas industries are outlined below:

Offshore storage terminal or subsea development structure.

Shown as FIG. 3.0, the structure can be towed to location and self installed on to the sea bed. If required, the skirts will be designed to penetrate the soil to provide additional sliding foundation stability.

The advantage of this system is that no external vessels are required to provide stability during descending/ascending because its stability does not depend on the surface piercing, these members can be made as small as structurally possible, minimising the exposure to environmental loads. A more detailed drawing of the deep sea development shown in FIG. 8.0. The stability tanks are marked as 25. The low and high pressure gas supply tanks are shown within the pontoons but they can be anywhere as long as the pressure drop in any interconnecting pipe is taken into account during the design. The main support columns are shown as marked 30, the vertical column would house caissons, conductors and rises marked 23 as required. Low pressure tanks are the vent tanks receiving supply from the vent system and high pressure tanks supply compressed air to the compressed air supply system. The vented air is fed into the compressor marked 28 via the low pressure pipe 28 and compressed air into the HP tanks through pipe 27. The emergency supply compressed air and choke facility shown as 29 which may be used as a back up if the compression facility fails. The deck 22 will be sized to take the required facilities.

Minimum facility self installing reusable structures.

Three examples of this type are shown in FIGS. 5, 6 and 7. FIG. 5 shows the braced monopod concept which can be towed to location and lowered to the sea bed either by venting compressed air or ballasting without requiring external vessels for stability. The air cushion will provide damping as the structure approaches the sea bed.

Once on the sea bed the compressed air can be vented providing a gravity foundation. The weight of the foundation can be increased by ballasting with heavy ballast such as drilling mud or sand both of which can be easily removed. The compressed air is pumped into the stability compartments to facilitate the control ascending of the structure. The ballasts will also need to be adjusted at this stage. If the centre of gravity is not suitable for stability during transport and installation, the deck can be made to rest at a lower position and raised after the installation. The same concept also applies to the braced tower, FIG. 6.0 and the mono-pile FIG. 7.0. The main advantage of FIG. 6.0 over the braced monopod is its capacity against ship impact. At least one of the legs of the 3 or 4 leg configuration shown in FIG. 6.0 can be used to support the appurtenances such as the risers and the conductors within them. This will further reduce the wave area minimising the environmental loads on the structure. The monopile shown as FIG. 7.0 can be used to support well conductors internally thereby allowing the wells/Christmas trees to be completed and tested prior to production deck being installed next to it and connected.

Another application may be as part of a loading terminal.

Figure 10:
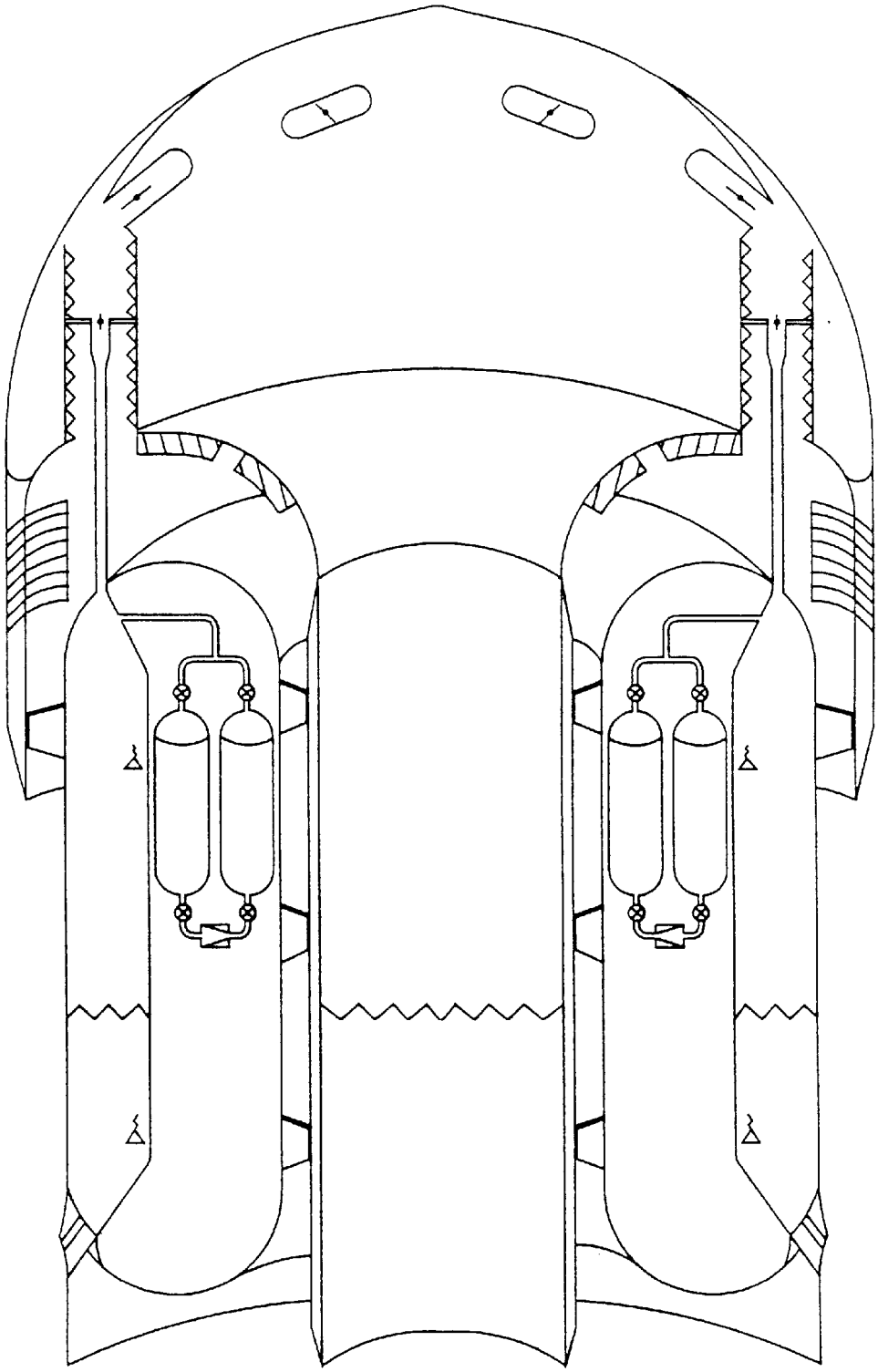
FIG. 10 illustrates a cross-section of a complete buoyancy assembly according to a second embodiment.

A further embodiment of the invention is shown in FIG. 10, but the shape of the body can be altered to suit specific application. However, the basic principals would apply to any marine application which require buoyancy and a restoring force when disturbed from a position of equilibrium. The characteristics of the invention are explained by referring to FIG. 10. The fundamental component of the invention can be grouped into 3 units.

Figure 11:
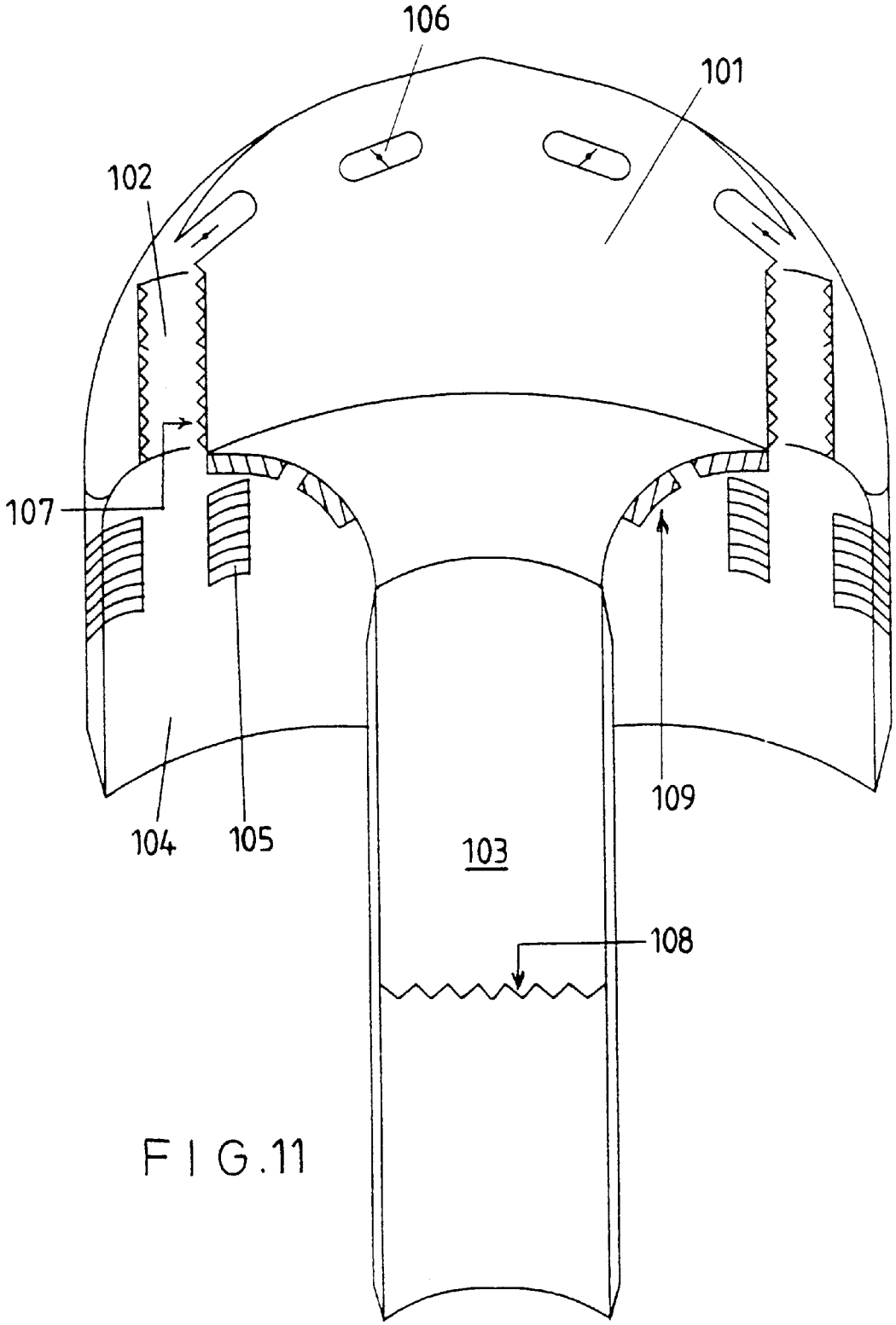
FIG. 11 illustrates in cross-section the first portion or casing of the embodiment illustrated in FIG. 10.

Unit 1, or first portion, is shown as FIG. 11 and consist of central tank marked 101 and peripheral tank marked 102 both of which are filled with compressed gas or air. To minimise the risk of total failure, these tanks will need to have a number of independent compartments but this is not essential for the working of the device. The two tanks are connected via openings and valves marked 106. The separation of Unit 1 into two tanks is only necessary to facilitate a facility whereby the response characteristics of the vessel can be altered to suit different loading conditions. This is done by adjusting the size of the opening between the two chambers via valve 106. In the sea, waves are of random size and frequency. Offshore structures, whether floating or fixed, will respond to wave loading depending on the frequency of the waves and the vessel's own natural dynamic response characteristics. Prior art with respect to the ships, column stabilised vessels, tethered platforms and the piled or gravity foundation platforms have not got the means of altering their dynamic response characteristics to suit the changes in the sea state. Centre column of Unit 1, made up of a dependent skirt marked 103 is open to the sea at the bottom. The level of water in the column is dependant on the compressed air pressure and the water depth to the pool surface marked 108. The outer shell or skirt marked 104 of the outer chamber is extended to shroud Unit 2 and minimise the effect of the environment on it. The shroud has inclined slatted openings marked 105, which allow free water flow through the inclined openings whilst stopping current or waves to affect the area inside. The bumpers/rubbing strips, marked 109 are used to allow Unit 1 to rest on the buoyancy tanks, marked 110 of the Unit 2 (see FIG. 12) for transportation. The compressed air is sealed off the sea via air tight seals in the plunger chamber marked 107.

It will therefore be appreciated that Unit 1 acts as a form of casing which acts as a guide for Unit 2. It also acts as a retaining member for Unit 2.

Figure 12:
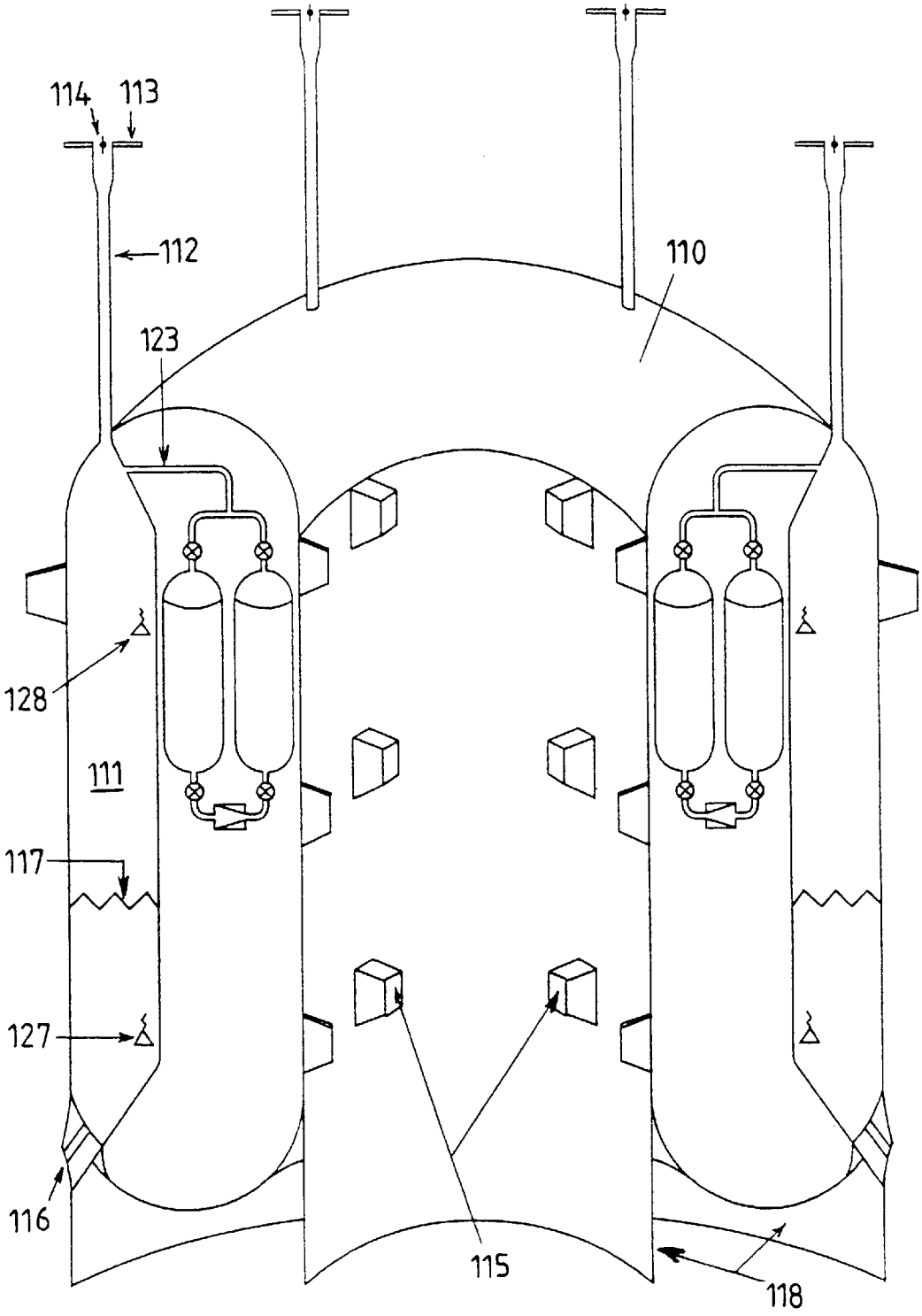
FIG. 12 illustrates in cross-section the second portion or plunger system of the embodiment illustrated in FIG. 10.
Figure 14:
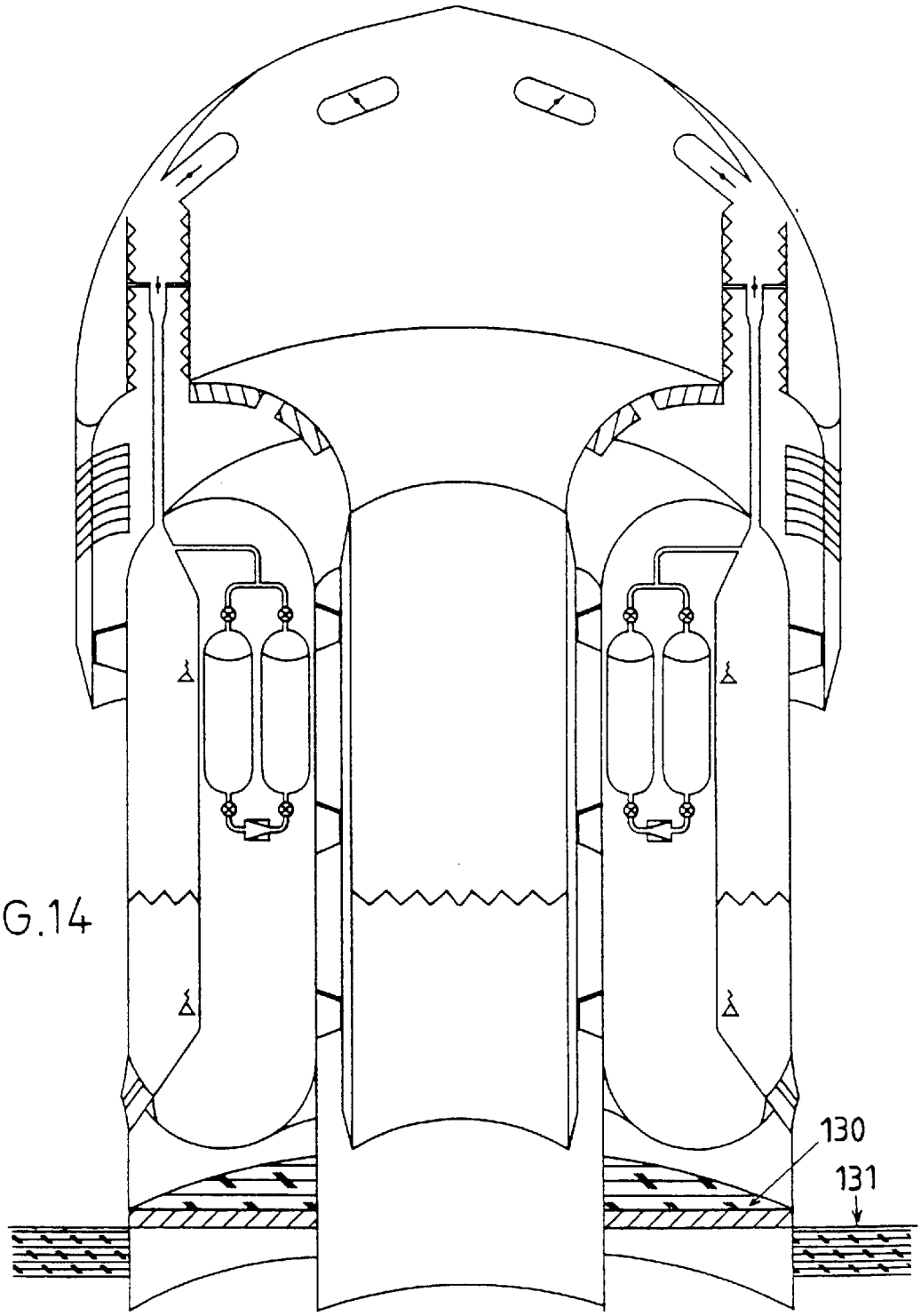
FIG. 14 shows the buoyancy assembly operating as a sea bed foundation.

Unit 2, or second portion, is the plunger system, shown as FIG. 12 and consists of the large tanks marked 110 which provide buoyancy, mass inertia, sufficient drag area and added mass volume to force the plunger to lag relative to the Unit 1 vertical motions. The Unit 2 also consist of active ballast tanks marked 111, plunger pipe marked 112, plungers marked 113 and plunger opening marked 114. To minimise the risk of total failure, these tanks will need to have a number of independent compartments but this is not essential for the working of the device. The plunger, which takes the form of an annular cylinder, is free to move vertically within the plunger chamber marked 107 (see FIG. 11) with the compressed air on top sealed from the sea below. The active ballast tank is open to the sea at the bottom through the inclined slatted openings marked 116. The opening is slatted to minimise the effect of the environment in the tank. The level of water in these tanks is dependant on the pressure from the sea at the level of the openings, and the compressed air pressure acting on the ballast water surface marked 117. The top of the active ballast tank is open to the compressed air in the plunger chamber via the plunger opening 14. Therefore, any change in the air pressure in the plunger chamber due to the movement of Unit 1 would affect the air pressure within the tank and thus the level of the ballast water. Therefore, when Unit 1 is forced downwards compressing the air and developing increasing pressure on the plunger, because of the plunger opening marked 114, same pressure would act within the active ballast tank forcing the ballast water out and providing reduction in weight, keeping Unit 2 in equilibrium. The same will be true in reverse if Unit 1 were forced upwards. The valve shown in the opening would be used to regulate the air flow into the tank to optimise the effect of this pressure change but not essential for basic working of the system. Unit 2 also have a skirt marked 118, which is open ended and provides additional hydrodynamic resistance and also if set on the sea bed it would penetrate into the soil and provide sliding stability. In this case either the bottom of the tanks or specifically designed mud mats marked 130 would act as vertical support on the soil marked 131. (see FIG. 14)

Figure 13:
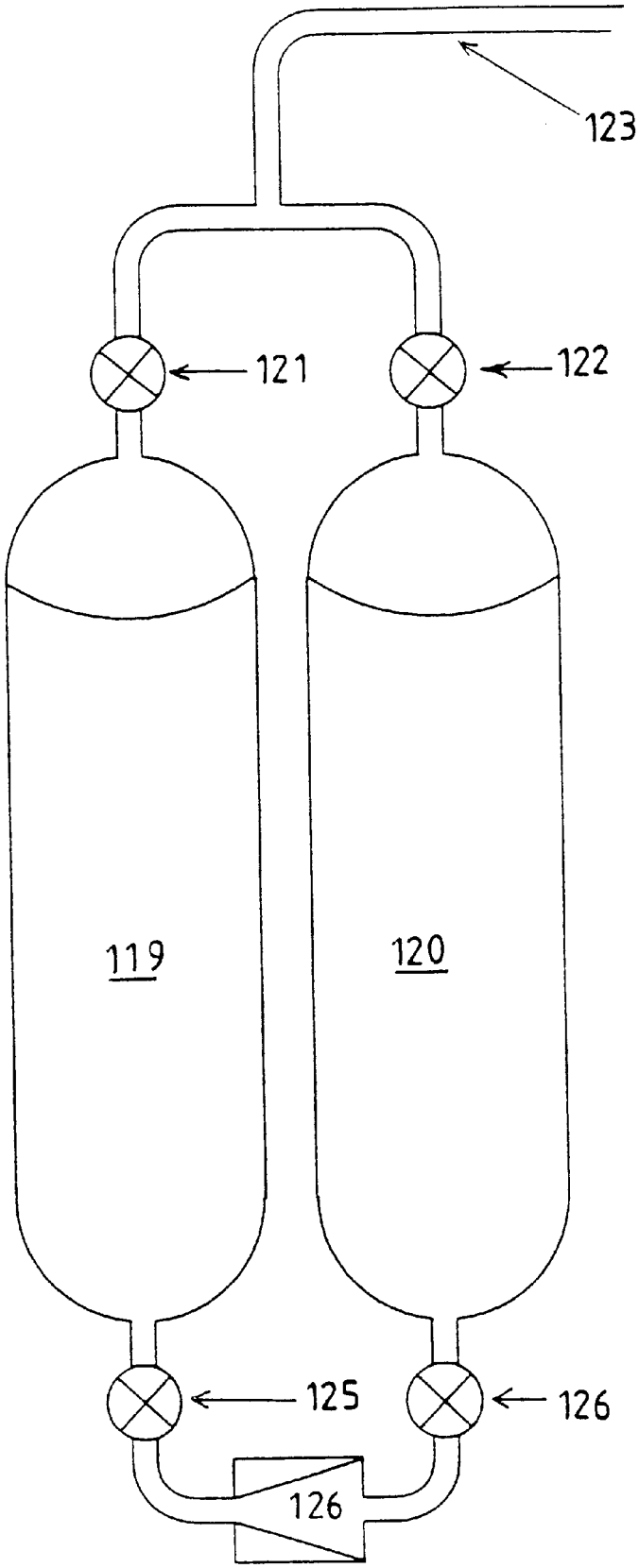
FIG. 13 illustrates the air vent and compressed air supply system from an active buoyancy system.

Unit 3 is the air vent and compressed air supply system shown as FIG. 13. It consists of compressed air cylinders marked 119, low pressure cylinders marked 120, one way control valve marked 121 for high pressure supply, one way control valve marked 122 for venting air from the active ballast tanks and system of valves and compressors for compressing the air from the low pressure cylinders to high pressure cylinders marked 124, 125, 126. The air pressure inside the active ballast tank is controlled via the supply pipe marked 123 either by venting the pressure into the low pressure cylinder or supplying from the high pressure cylinder. The control valves will be operating by detecting changes in the air pressure inside the active ballast tanks via pressure detectors marked 128 (see FIG. 12) with respect to the hydrostatic pressure change detected by the detector close to the bottom of the active ballast tank, marked 127 (see FIG. 12). The pressure difference between the two would indicate the height of the ballast water in the tank. If the hydrostatic pressure increases whilst the air pressure is not changed or decreasing, it means that the Unit 2 is moving downwards from its equilibrium depth. In this case, the control valve marked 121 is activated supplying pressure until the hydrostatic pressure is equal to the reference pressure at the equilibrium depth. If the hydrostatic pressure is decreasing and the air pressure is not changing or increasing, it means that the Unit 2 is moving upwards from its equilibrium depth. In this case the venting control valve marked 122 will be activated until the hydrostatic pressure is equal to the reference pressure which is the pressure at the equilibrium depth.

The fundamental principals of the invention are explained below:

When the initial equilibrium of the system is disturbed moving up or down, Unit 1 and Unit 2 either will move together or relative to each other. Unit 2 is a plunger system and designed to resist vertical motions. This is achieved by designing Unit 1 open ended so that all the buoyancy of the system is provided by Unit 2 by supporting the compressed air pressure on the plunger marked 113. Without the excess buoyancy of Unit 2 which is balanced by the compressed air pressure acting on the plunger, Unit 1 would simply be filled with water and would not be able to support its own weight and that of the cargo. This is done deliberately so that Unit 2 would have large mass inertia, large cross sectional area and large water displacement volume maximising resistance to its movement. Unit 2 is also shrouded as much as possible from loading due to waves and current, marked 104 (see FIG. 11) and is not vertically connected to anything. The deck, cargo and the substructure are connected on to Unit 1.

When Unit 1 moves relative to Unit 2 vertically up or down under the influence of the wave loading on itself and other structures connected to it, or due to changes in the cargo, the volume of the compressed air will change while Unit 2 resists the movement until enough force develops on the plunger to initiate the movement of Unit 2. This change in the volume of the compressed air provides a restoring force for Unit 1. Even without the active ballast system, marked 111 and Unit 3 which are there to ensure that unit 2 is not forced away from its equilibrium position, the system will provide a restoring force for temporary loading like small waves. The active ballast system provides a way of ensuring that Unit 2 remains in equilibrium whilst Unit 1 moving relative to it, developing a restoring force due to the changes in the compressed air pressure.

Unit 3 is a backup and supplementary system, that would come in to operation when for whatever reason Unit 2 moves relative to Unit 1.

Some of the main advantages of this invention are outlined below:

- The body would be hydrostatically stable even when fully submerged
- The system's stability characteristics can be altered to suit the different sea states without increasing the environmental loading
- It minimises the environmental loading by providing a stable buoyant system which can sit below the major influences of the environment.
- It is simple, safe and reliable.

When on the sea bed, the skirts will penetrate the soil providing sliding stability and also foundation that would minimise or eliminate the foundation loads acting on the sea bed. Therefore it can be used for any soil conditions.

The device makes it possible to design self transporting, self installing and re-useable marine bodies for any depth. For deep waters the device would be floating fully submerged at a suitable depth providing buoyancy and stability for a floating marine body. For moderate to shallow depths the device would provide buoyancy and hydrostatic stability whilst descending and ascending and foundation stability while sitting on the sea bed supporting a deck above the sea surface. It can also be used for designing self transporting, self installing re-useable subsea structures which are fully submerged sitting on the sea bed being used for storage or production.

I claim:

1. A buoyancy assembly suitable for supporting, either alone or in combination, a load deck or other marine body said assembly comprising:

(i) a first portion adapted to be connected to the marine body, said first portion defining a chamber adapted to contain a variable volume of compressed gas, the first portion being open to the water at or near its lowermost-in-use region to allow ingress of water to form a water pool inside the first portion, the surface of the water pool being in contact with the compressed gas above it:

(ii) a second portion adapted to be moveable in relation to the first portion said second portion also defining a chamber adapted to contain a variable volume of compressed gas;

wherein the assembly also comprises a connecting means adapted to enable gas to flow between the first and second portions and vice-versa, the assembly being adapted such that when the assembly is displaced from equilibrium, either up or down, the free surface of the water pool in the first portion will rise or fall with respect to its equilibrium position and the resulting change in gas pressure in the gas above the water pool will cause the first and second portions to move with respect to each other such that a restoring force, upwards or downwards, is generated tending to restore equilibrium.

2. A buoyancy assembly as claimed in claim 1 wherein the second portion is open to the water at or near its lowermost-in-use region.

3. A buoyancy assembly as claimed in claim 1, wherein the first portion comprises a casing which, in its normal orientation in use, incorporates at least one dependent skirt, the skirt(s) being aligned with the longitudinal axis of the first portion, said at least one skirt acting to constrain the second portion to move substantially parallel to the longitudinal axis of the casing.

4. A buoyancy assembly as claimed in claim 3, wherein the first portion further incorporates a dependent shroud extending substantially around the perimeter of the casing.

5. A buoyancy assembly as claimed in claim 4 wherein the shroud incorporates at least one opening to allow access and egress of water.

6. A buoyancy assembly according to claim 1, wherein the second portion comprises an annular cylinder, at least a portion of the cylinder being open to the water at its lowermost in use end, the water level in the first and second portions being substantially the same at hydrostatic equilibrium.

7. A buoyancy assembly as claimed in claim 6, wherein the annular cylinder is compartmentalised, the lowermost in use end of at least one compartment being closed to the water, the closed compartment being adapted to contain compressed air or ballast or a mixture of both.

8. A buoyancy assembly as claimed in claim 1, wherein the assembly further comprises an active ballasting system comprising:

i) low pressure gas reservoir;

ii) high pressure gas reservoir;

iii) compressor;

iv) control system;

the ballasting system being adapted to supplement the restoring force exerted by the movement of the first portion relative to the second by varying the gas pressure as required.

9. A buoyancy assembly as claimed in claim 1, wherein the lowermost in use region incorporates one or more skirts adapted to penetrate the sea bed to provide lateral stability when the unit rests on the sea bed.

10. A marine body incorporating a buoyancy assembly as claimed in claim 1.

11. A method of stabilizing a marine body comprising the steps of:

a. providing one or more buoyancy assemblies;

b. attaching the or each buoyancy assembly to a marine body;

c. providing a control system adapted to control the operation of the or each buoyancy assembly such that the marine body is stabilized at the desired point of hydrostatic equilibrium or provided with the desired foundation stability and;

d. the or each buoyancy assembly comprising:

i) a first portion connected to the marine body, said first portion defining a chamber containing a variable volume of compressed gas, the first portion being open to the water at or near its lowermost-in-use region to allow ingress of water to form a water pool inside the first portion, the surface of the water pool being in contact with the compressed gas above it;

ii) a second portion moveable in relation to the first portion, said second portion also defining a chamber containing a variable volume of compressed gas;

wherein the assembly also comprises a connecting system enabling gas to flow between the first and second portions and vice-versa, such that when the assembly is displaced from equilibrium, either up or down, the free surface of the water pool in the first portion rises or falls with respect to its equilibrium position and the resulting change in gas pressure in the gas above the water pool causes the first and second portions to move with respect to each other such that a restoring force, upwards or downwards, is generated tending to restore equilibrium.

12. A method as claimed in claim 11, wherein the second portion is open to the water at or near its lowermost-in-use region.

13. A method as claimed in claim 11, wherein the first portion comprises a casing which, in its normal orientation in use, incorporates at least one dependent skirt, the skirt(s) being aligned with the longitudinal axis of the first portion, said at least one skirt acting to constrain the second portion to move substantially parallel to the longitudinal axis of the casing.

14. A method as claimed in claim 11, wherein the first portion further incorporates a dependent shroud extending substantially around the perimeter of the casing.

15. A method as claimed in claim 11, wherein the shroud incorporates at least one opening to allow access and egress of water.

16. A method according to claim 11, wherein the second portion comprises an annular cylinder, at least a portion of the cylinder being open to the water at its lowermost in use end, the water level in the first and second portions being substantially the same at hydrostatic equilibrium.

17. A method as claimed in claim 11, wherein the annular cylinder is compartmentalized, the lowermost in use end of at least one compartment being closed to the water, the closed compartment being adapted to contain compressed air or ballast or a mixture of both.

18. A method as claimed in claim 11, further comprising supplementing the restoring force exerted by the movement of the first portion relative to the second by varying the gas pressure.

19. A method as claimed in claim 11, wherein the lowermost in use region incorporates one or more skirts penetrating the sea bed to provide lateral stability when the unit rests on the sea bed.

* * * * *